US009174759B2

(12) United States Patent
Yourist et al.

(10) Patent No.: US 9,174,759 B2
(45) Date of Patent: Nov. 3, 2015

(54) BLOW MOLDED PLASTIC CONTAINER HAVING IMPROVED TOP LOAD STRENGTH

(75) Inventors: Sheldon E. Yourist, York, PA (US); Larry M. Taylor, Landisville, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 154 days.

(21) Appl. No.: 13/044,649

(22) Filed: Mar. 10, 2011

(65) Prior Publication Data

US 2012/0228183 A1 Sep. 13, 2012

(51) Int. Cl.

| | |
|---|---|
| ***B65D 6/28*** | (2006.01) |
| ***B65D 8/04*** | (2006.01) |
| ***B65D 8/06*** | (2006.01) |
| ***B65D 1/20*** | (2006.01) |

(52) U.S. Cl.

CPC ..... *B65D 1/20* (2013.01)

(58) Field of Classification Search

CPC ..... B65D 1/42; B65D 1/46; B65D 1/44; B65D 2501/0027; B65D 2501/0036; B65D 2501/0045

USPC ..... 220/608, 671; 215/42, 382, 383; 222/572

See application file for complete search history.

(56) References Cited

U.S. PATENT DOCUMENTS

| | | | | | |
|---|---|---|---|---|---|
| 463,335 | A | * | 11/1891 | Mulford | 366/283 |
| D137,943 | S | * | 5/1944 | Schlumbohm | D7/318 |
| 3,235,111 | A | * | 2/1966 | Whitton, Jr. et al. | 215/43 |
| 3,434,635 | A | * | 3/1969 | Mason, Jr. | 222/468 |
| 4,412,633 | A | * | 11/1983 | Guerrazzi et al. | 222/468 |
| 5,114,028 | A | * | 5/1992 | Ring | 215/42 |
| 5,265,743 | A | * | 11/1993 | Frohn | 215/10 |
| 6,070,753 | A | * | 6/2000 | Hirst et al. | 220/674 |
| D439,166 | S | * | 3/2001 | Denner et al. | D9/538 |
| 6,672,468 | B1 | * | 1/2004 | Mount et al. | 215/42 |
| 7,137,521 | B2 | * | 11/2006 | Yourist | 215/398 |
| 2010/0006535 | A1 | * | 1/2010 | Ogg | 215/384 |

OTHER PUBLICATIONS

"Polyclear EBM PET 5505" Preliminary Property Data Sheet, Invista S.a.r.l. issued Nov. 23, 2010.

* cited by examiner

*Primary Examiner* — Anthony Stashick
*Assistant Examiner* — Blaine Neway
(74) *Attorney, Agent, or Firm* — Baker Botts L.L.P.

(57) ABSTRACT

A blow molded plastic container includes a main body portion having an upper surface and a finish portion that extends from the upper surface. A reinforcing strut is provided on the upper surface of the main body portion adjacent to the finish portion for providing increased structural rigidity and top load strength to the container. The reinforcing strut may be fabricated in a manner that promotes drainage of fluid from the container, such as by defining a downwardly sloping inner channel that leads to the finish portion when the container is inverted.

22 Claims, 5 Drawing Sheets

BLOW MOLDED PLASTIC CONTAINER HAVING IMPROVED TOP LOAD STRENGTH

BACKGROUND OF THE INVENTION

1. Field of the Invention

This invention relates to blow molded plastic containers, and in particular to containers that require enhanced top load strength characteristics, especially in the region about the finish portion.

2. Description of the Related Technology

Many products that were previously packaged using glass containers are now being supplied in plastic containers. Polyethylene terephthalate (PET) thermoplastic resins are polyester materials that provide clarity and transparency that are comparable to glass. PET possesses the processing characteristics, chemical and solvent resistance and high strength and impact resistance that are required for packaging products such as juices, soft drinks and water. PET containers are lightweight, inexpensive, and recyclable and can be economically manufactured in large quantities. They will not shatter and create potentially dangerous shards when dropped, as a glass container may.

PET containers have conventionally been manufactured using the stretch blow molding process. This involves the use of a pre-molded PET preform having a threaded portion and a closed distal end. The preform is first heated and then is longitudinally stretched and subsequently inflated within a mold cavity so that it assumes the desired final shape of the container. As the preform is inflated, it elongates and stretches, taking on the shape of the mold cavity. The polymer solidifies upon contacting the cooler surface of the mold, and the finished hollow container is subsequently ejected from the mold.

Another well-known process for fabricating plastic containers is the extrusion blow molding process, in which a continuously extruded hot plastic tube or parison is captured within a mold and inflated against the inner surfaces of the mold to form a container blank. In such systems, the mold is typically designed to travel at the speed at which the extruded parison is moving when it closes on the parison so that the process can operate on a continuous basis. There are several different types of extrusion blow molding machines, including shuttle molds that are designed to travel in a linear motion and extrusion blow molding wheels that travel in a rotary or circular motion.

Extrusion blow molding is typically used to form plastic containers, such as motor oil containers, from nontransparent materials such as polyolefin or polyethylene. In the past, it was not typical to use extrusion blow molding to fabricate PET containers, because no commercially available PET material provided the required melt strength for extrusion blowmolding in addition to being compatible with standard PET recycling processes. More recently, however, extrudable PET (EPET) materials have been made commercially available that can be processed at temperatures and conditions similar to standard PET and that provide the required melt strength for extrusion blow molding. Such materials have higher melt temperatures than the polyethylene or polyolefin materials that are typically used with extrusion blowmolding. A limited number of PET containers that are fabricated using extrusion blow molding have now been commercially introduced.

Despite the advantages of plastic materials such as PET, glass containers are still prevalent for certain products, particularly those that require a substantial amount of column or top load strength so that the structural integrity of the container is not compromised when the containers are stacked in boxes or pallets and subjected to substantial vertical compressive forces. In many plastic container designs, the neck and shoulder portions are the weakest link in terms of the column strength of the container. The column strength of the container may also be reduced in container designs that have a main body portion with a broad upper surface adjacent to the finish portion of the container that does not slope sharply downward. In such container designs, downward force applied to the finish portion may cause the upper surface of the container to deflect downwardly and possibly buckle.

In order to minimize material costs, it is desirable to make the sidewall of these container portions, as with the rest of the container, as thin as possible. However, such lightweighting comes at the expense of container strength, and in particular column strength.

In the packaging of certain types of beverages, a rinsing agent is applied to the inner surfaces of the container, which must be drained from the container prior to filling the container with product. Any structural reinforcement that is provided to the upper portions of the container ideally should not interfere with efficient drainage of the rinsing agent from the container.

A need exists for a PET container that can be manufactured using an extrusion blow molding process that exhibits superior column strength, particularly in the upper regions of the container that are adjacent to the finish portion, and that does not adversely impact drainage from the container.

SUMMARY OF THE INVENTION

Accordingly, it is an object of the invention to provide a PET container that can be manufactured using an extrusion blow molding process that exhibits superior column strength, particularly in the upper regions of the container that are adjacent to the finish portion, and that does not adversely impact drainage from the container.

In order to achieve the above and other objects of the invention, a blow molded plastic container according to a first aspect of the invention includes a main body portion having a central longitudinal axis and an upper surface, and a finish portion that is unitary with the main body portion. The finish portion extends upwardly from the upper surface. The container further advantageously includes a reinforcing strut that is defined in the upper surface adjacent to the finish portion.

A blow molded plastic container according to a second aspect of the invention includes a main body portion having a central longitudinal axis and an upper surface; a finish portion that is unitary with the main body portion and extends upwardly from the upper surface; and a drainage channel defined in the upper surface, the drainage channel being in communication with the finish portion.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
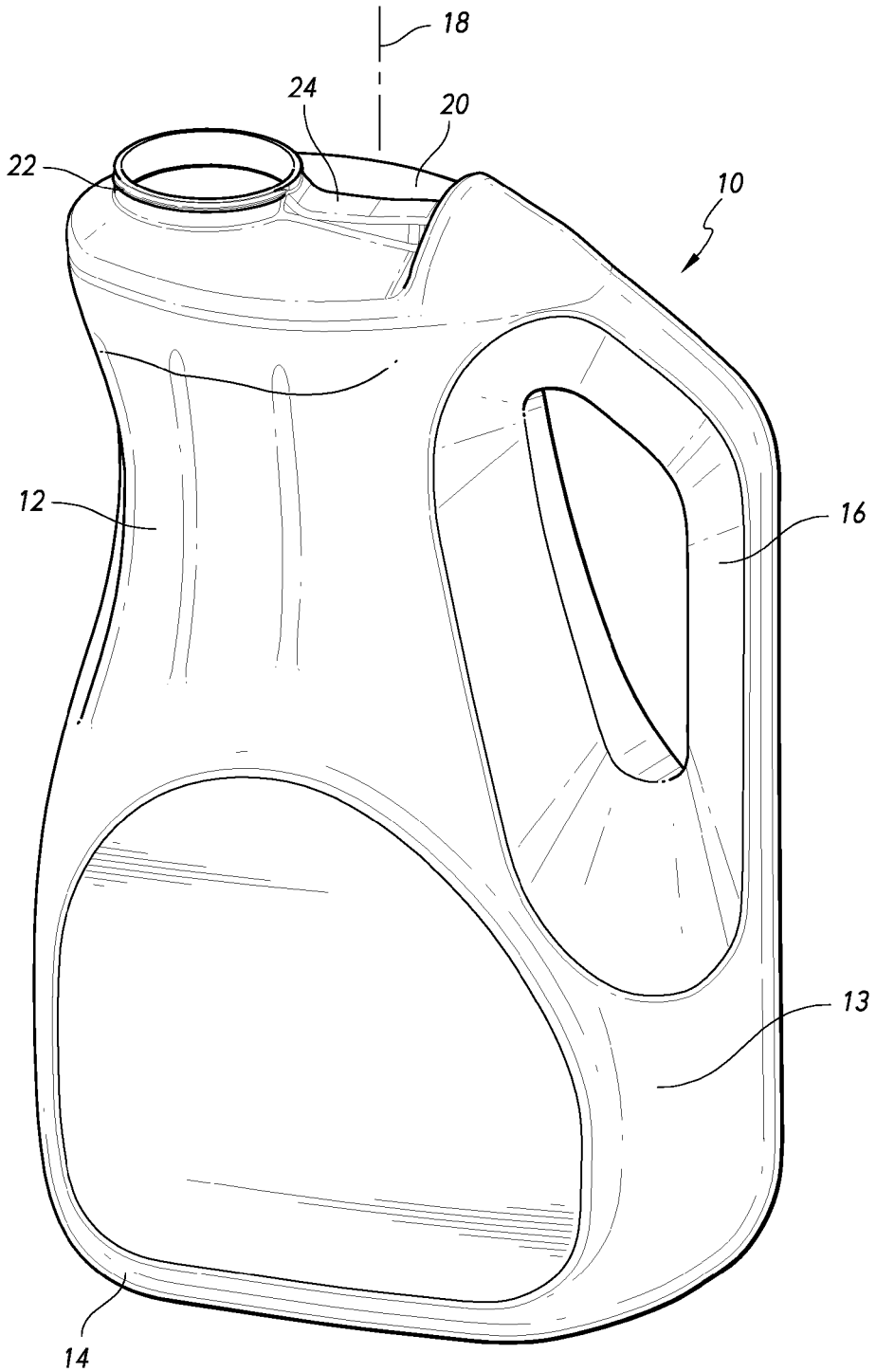
FIG. 1 is a perspective view of a plastic container that is constructed according to a preferred embodiment of the invention.

Referring now to the drawings, wherein like reference numerals designate corresponding structure throughout the views, and referring in particular to FIG. 1, a blow molded plastic container 10 that is constructed according to a preferred embodiment of the invention includes a main body portion 12 that has a central longitudinal axis 18. The main body portion 12 has a bottom portion 14, and in the preferred embodiment has a handle 16 defined therein. The main body portion 12 has a thin sidewall 13 having an outer surface and an inner surface that defines a substantially hollow interior space.

The container 10 in the preferred embodiment is fabricated from an extrudable polyethylene terephthalate (EPET) material using an extrusion blow molding process. Most preferably, container 10 is fabricated from Invista Polyclear® EBM PET 5505 extrudable polyethylene terephthalate (EPET) material.

Figure 3:
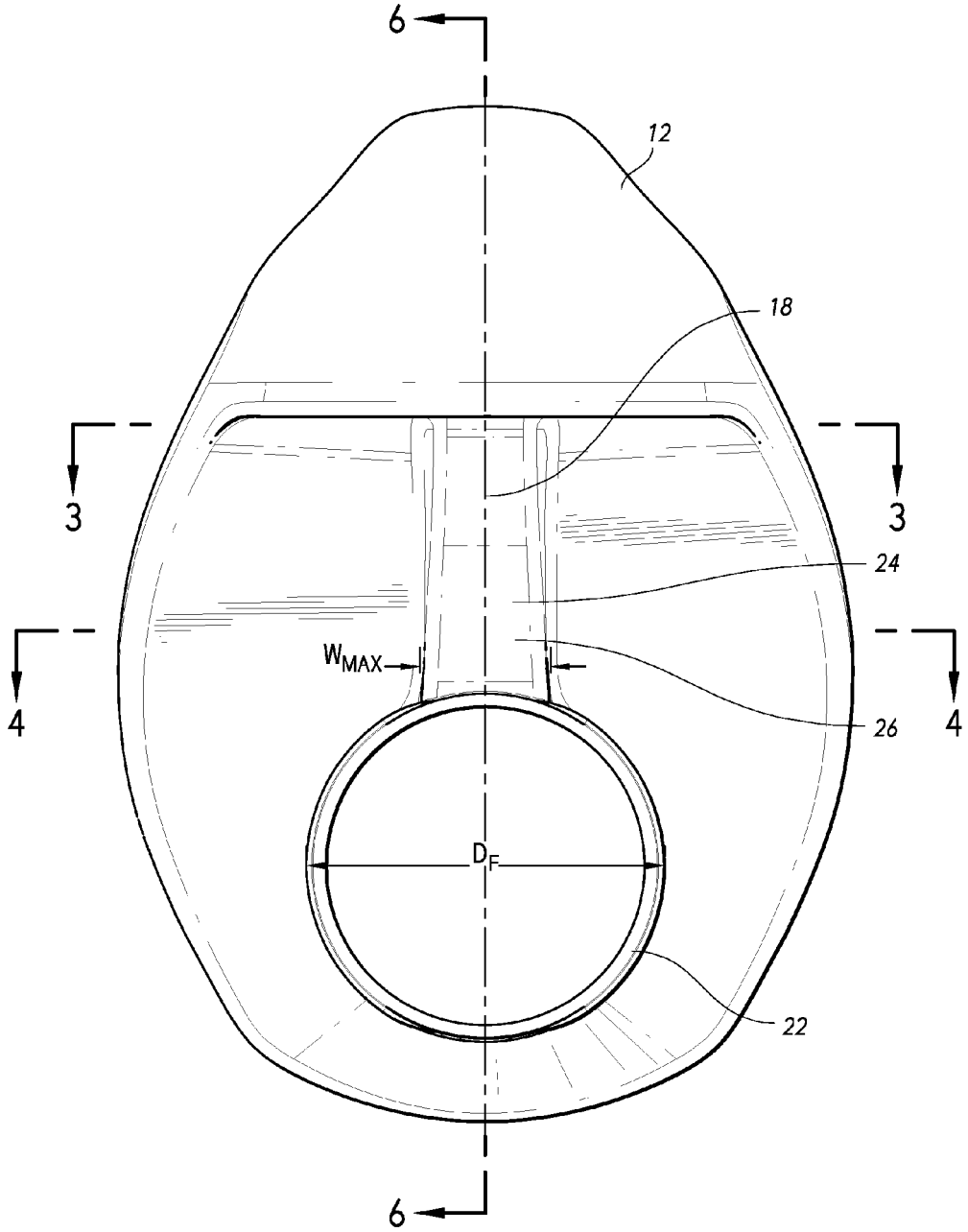
FIG. 3 is a top plan view of the plastic container that is shown in FIG. 1.

The main body portion 12 of the container 10 includes an upper surface 20 from which a finish portion 22 extends upwardly. Referring to FIG. 3, it will be seen that finish portion 22 is unitary with the main body portion 12 and preferably has a substantially cylindrical shape, having an outer diameter $D_F$. Preferably, the finish portion 22 is offset from the central longitudinal axis 18 of the container 10. In other words, it is positioned towards one side of the upper surface 20.

A reinforcing strut 24 is advantageously defined in the upper surface 20 adjacent to the finish portion 22. In the preferred embodiment, the reinforcing strut 24 is positioned on the same side of the finish portion 22 that faces the central longitudinal axis 18.

Preferably, the reinforcing strut 24 is integrally formed with the rest of the main body portion 12 and is defined from and forms part of the thin sidewall 13. In other words, the reinforcing strut 24 has a thin sidewall throughout. The reinforcing strut 24 is also preferably unitary with part of the finish portion 22. The reinforcing strut 24 is preferably constructed to create a downwardly sloping inner channel 40, best shown in FIG. 6, which facilitates drainage of fluid from the container 10 into the finish portion 22 when the container 10 is inverted. This is most advantageous during the sterilization process, in which a rinsing agent must be drained from the container 10.

Figure 2:
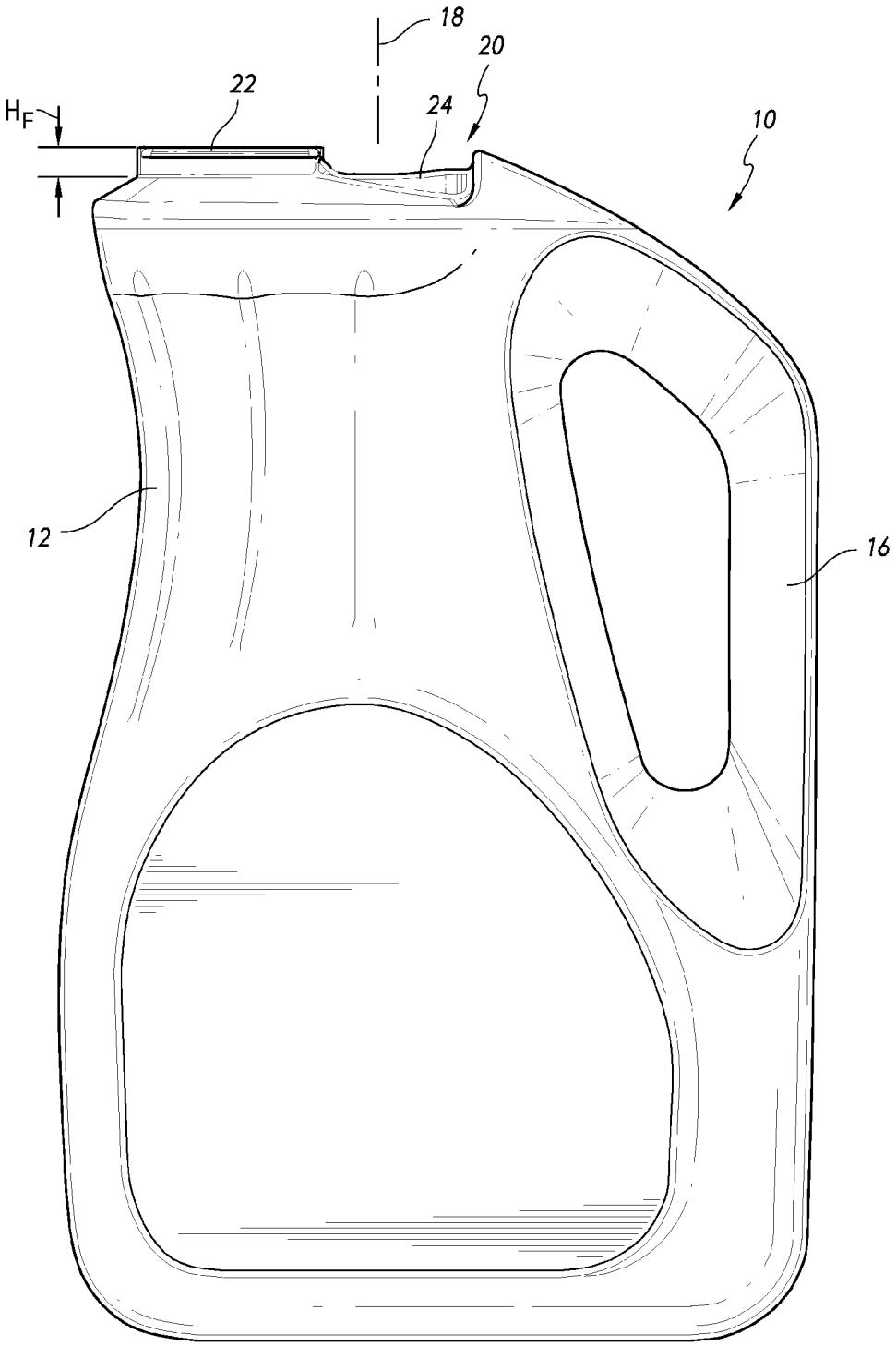
FIG. 2 is a side elevational view of the plastic container that is shown in FIG. 1.

As is best shown in FIG. 2, the finish portion 22 has a maximum height $H_F$. Preferably, the reinforcing strut 24 contacts the finish portion 22 along at least 20% of the maximum height $H_F$, more preferably along at least 30% of the maximum height $H_F$ and most preferably along at least 40% of the maximum height $H_F$.

Figure 4:
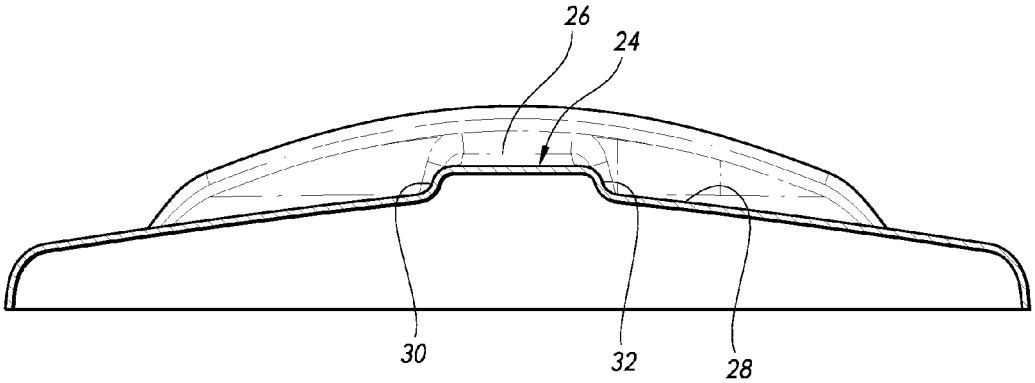
FIG. 4 is a cross-sectional view taken along lines 4-4 in FIG. 3.
Figure 5:
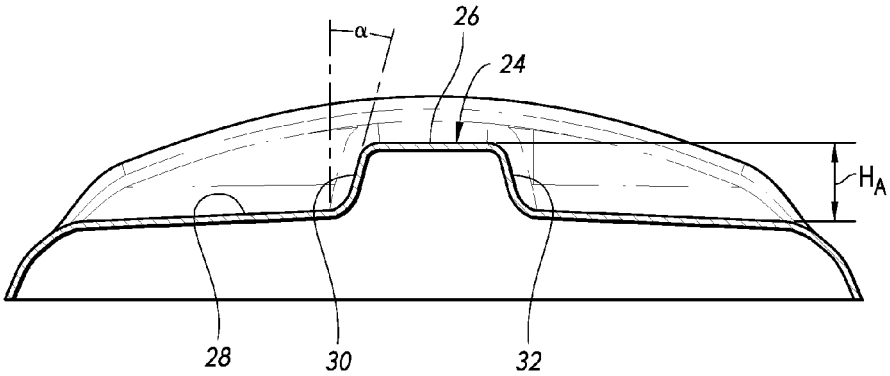
FIG. 5 is a cross-sectional view taken along lines 5-5 in FIG. 3.

The reinforcing strut 24 preferably defines a top surface 26 and a pair of tapered side surfaces 30, 32 that are tapered inwardly and upwardly so as to cause the upper surface 26 to have a width that is less than a base width of the reinforcing strut 24, which is where it merges into the adjacent portion 28 of the upper surface 20. Fillets are preferably provided to create a smooth transition between the respective side surfaces 30, 32 and the adjacent portion 28 of the upper surface 20. Convex radii are preferably provided to create a smooth transition between the respective side surfaces 30, 32 and the upper surface 26. In transverse cross-section, as shown in FIGS. 4 and 5, the reinforcing strut 24 may have a substantially trapezoidal shape.

The height of the reinforcing strut 24 varies along its length in the preferred embodiment. As FIG. 5 shows, the reinforcing strut 24 has an average height $H_A$ with respect to the adjacent portion 28 of the upper surface 20. Preferably, a ratio $H_A/D_F$ of the average height $H_A$ to the diameter $D_F$ of the finish portion 22 is substantially within a range of about 0.02 to about 0.5. More preferably, this ratio $H_A/D_F$ is substantially within a range of about 0.03 to about 0.4 and most preferably the ratio $H_A/D_F$ is substantially within a range of about 0.04 to about 0.3.

Referring again to FIG. 5, it will be seen that the side surfaces 30, 32 of the reinforcing strut 24 are preferably substantially symmetrical in shape. Each side surface 30, 32 is preferably tapered at an angle $\alpha$ measured with respect to a line that is normal to the surface 28 that is substantially within a range of about 0° to about 60°, more preferably substantially within a range of about 1° to about 45° and most preferably substantially within a range of about 2° to about 20°.

Figure 6:
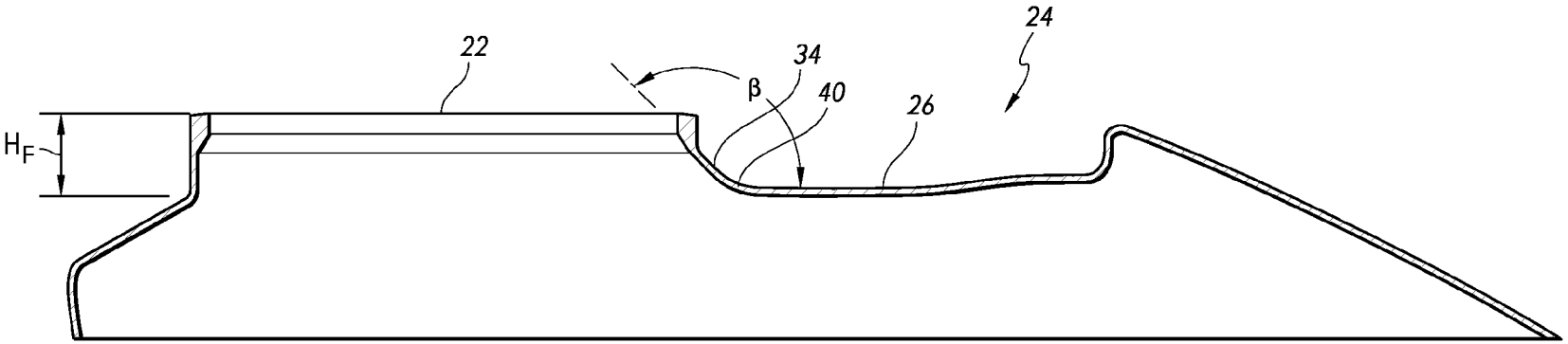
FIG. 6 is a cross-sectional view taken along lines 6-6 in FIG. 3.

Looking to FIG. 6, it will be seen that the reinforcing strut 24 has a tapered upper surface 34 near the finish portion 22 that defines an angle $\beta$ with respect to an adjacent portion of the reinforcing strut 24. Preferably, this angle $\beta$ is substantially within a range of about 100° to about 160° and more preferably substantially within a range of about 110° to about 145°.

Referring to FIG. 3, it will be seen that the reinforcing strut 24 has a maximum width $W_{MAX}$, which in the preferred embodiment is substantially adjacent to the finish portion 22. Preferably, a ratio $W_{MAX}/D_F$ of the maximum width $W_{MAX}$ to the diameter $D_F$ is substantially within a range of about 0.1 to about 0.8, more preferably substantially within a range of about 0.2 to about 0.6 and most preferably substantially within a range of about 0.3 to about 0.5.

The presence of the reinforcing strut 24 substantially improves the top load strength of the container 10, particularly in the portion of the upper surface 20 that is adjacent to the finish portion 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blow molded plastic container, comprising:

a main body portion having a central longitudinal axis and an upper surface;

a finish portion adapted to receive a closure, the finish portion being unitary with the main body portion and extending upwardly from the upper surface to define a maximum height; and a reinforcing strut defined in the upper surface, the reinforcing strut having a transition region proximate the finish portion and a generally planar top surface extending therefrom, the reinforcing strut increasing in height relative the upper surface with increasing distance from the transition region, wherein the reinforcing strut contacts the finish portion along at least 20% of the maximum height.

2. A blow molded plastic container according to claim 1, wherein the finish portion is offset from the central longitudinal axis of the main body portion.

3. A blow molded plastic container according to claim 1, wherein the reinforcing strut has an average height with respect to adjacent portions of the upper surface and the finish portion has a diameter, and wherein a ratio of the average height to the diameter is substantially within a range of about 0.02 to about 0.5.

4. A blow molded plastic container according to claim 3, wherein the ratio of the average height to the diameter is substantially within a range of about 0.03 to about 0.4.

5. A blow molded plastic container according to claim 4, wherein the ratio of the average height to the diameter is substantially within a range of about 0.04 to about 0.3.

6. A blow molded plastic container according to claim 1, wherein the reinforcing strut has at least one side tapered upwardly and inwardly from the upper surface.

7. A blow molded plastic container according to claim 6, wherein the at least one side of the reinforcing strut is tapered at an angle that is substantially within a range of about 0° to about 60°.

8. A blow molded plastic container according to claim 7, wherein the at least one side of the reinforcing strut is tapered at an angle that is substantially within a range of about 1° to about 45°.

9. A blow molded plastic container according to claim 8, wherein the at least one side of the reinforcing strut is tapered at an angle that is substantially within a range of about 2° to about 20°.

10. A blow molded plastic container according to claim 1, wherein the reinforcing strut contacts the finish portion along at least 30% of the maximum height.

11. A blow molded plastic container according to claim 10, wherein the reinforcing strut contacts the finish portion along at least 40% of the maximum height.

12. A blow molded plastic container, comprising:

a main body portion having a central longitudinal axis and an upper surface;

a finish portion that is unitary with the main body portion and extends upwardly from the upper surface to define a maximum height; and a reinforcing strut defined in the upper surface, the reinforcing strut having an upwardly-tapered transition region proximate the finish portion and a top surface extending therefrom, the upwardly-tapered transition region defining an angle with respect to the top surface, the angle being substantially within a range of about 100° to about 160°, the reinforcing strut defining an inner channel sloped downwardly into the finish portion when the container is in an inverted position, wherein the reinforcing strut contacts the finish portion along at least 20% of the maximum height.

13. A blow molded plastic container according to claim 12, wherein the angle is substantially within a range of about 110° to about 145°.

14. A blow molded plastic container according to claim 12, wherein the finish portion has a diameter and the reinforcing strut has a maximum width, and wherein a ratio of the maximum width to the diameter is substantially within a range of about 0.1 to about 0.8.

15. A blow molded plastic container according to claim 14, wherein the ratio of the maximum width to the diameter is substantially within a range of about 0.2 to about 0.6.

16. A blow molded plastic container according to claim 15, wherein the ratio of the maximum width to the diameter is substantially within a range of about 0.3 to about 0.5.

17. A blow molded plastic container according to claim 12, wherein the reinforcing strut extends upwardly from the upper surface of the main body portion, the reinforcing strut increasing in height relative the upper surface with increasing distance from the upwardly-tapered transition region.

18. A blow molded plastic container according to claim 1, wherein the container is fabricated from a material comprising polyethylene terephthalate.

19. A blow molded plastic container according to claim 1, wherein the reinforcing strut creates a downwardly sloping inner channel into the finish portion when the container is inverted, whereby drainage of fluid from the container is facilitated.

20. A blow molded plastic container, comprising:

a main body portion having a central longitudinal axis and an upper surface;

a finish portion that is unitary with the main body portion, and extends upwardly from the upper surface to define a maximum height; and a reinforcing strut defined in the upper surface adjacent to the finish portion, wherein the reinforcing strut contacts the finish portion along at least 20% of the maximum height, extends a length from the finish portion and has a trapezoidal shape in transverse cross-section as viewed perpendicular to the length to define an inner channel sloped downwardly into the finish portion when the container is in an inverted position.

21. A blow molded plastic container according to claim 1, wherein the reinforcing strut has a trapezoidal shape in transverse cross-section as viewed perpendicular to the length.

22. A blow molded plastic container according to claim 12, wherein the reinforcing strut has a trapezoidal shape in transverse cross-section as viewed perpendicular to the length.

* * * * *